US007278463B2

(12) United States Patent
Snyder et al.

(10) Patent No.: US 7,278,463 B2
(45) Date of Patent: Oct. 9, 2007

(54) INVESTMENT CASTING CORES AND METHODS

(75) Inventors: Jacob A. Snyder, Windsor Locks, CT (US); James T. Beals, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/421,115

(22) Filed: May 31, 2006

(65) Prior Publication Data

US 2007/0114001 A1 May 24, 2007

Related U.S. Application Data

(62) Division of application No. 10/977,974, filed on Oct. 29, 2004, now Pat. No. 7,134,475.

(51) Int. Cl.
*B22C 9/04* (2006.01)
*B22C 1/00* (2006.01)

(52) U.S. Cl. ..... 164/412; 35/45; 35/516; 35/519

(58) Field of Classification Search ..... 164/35, 164/45, 516, 519, 412
See application file for complete search history.

(56) References Cited

U.S. PATENT DOCUMENTS

| | | | | |
|---|---|---|---|---|
| 6,626,230 | B1 | 9/2003 | Woodrum et al. | |
| 6,637,500 | B2 * | 10/2003 | Shah et al. | 164/369 |
| 6,896,036 | B2 * | 5/2005 | Schneiders et al. | 164/516 |
| 6,929,054 | B2 * | 8/2005 | Beals et al. | 164/369 |
| 2004/0020629 | A1 * | 2/2004 | Shah et al. | 164/369 |
| 2005/0087319 | A1 * | 4/2005 | Beals et al. | 164/45 |

* cited by examiner

*Primary Examiner*—Kuang Y. Lin
(74) *Attorney, Agent, or Firm*—Bachman & LaPointe, P.C.

(57) ABSTRACT

An investment casting pattern is formed by forming a metallic first core element including at least one recess. The first core element is engaged to at least a mating one of an element of the die and a second core element. The recess serves to retain the first core element relative to the mating one. The die is assembled and a sacrificial material is introduced to the die to at least partially embed the first core element. The recess may be pre-formed prior to cutting the first core element from a larger sheet of material.

12 Claims, 4 Drawing Sheets

INVESTMENT CASTING CORES AND METHODS

CROSS REFERENCE TO RELATED APPLICATION(S)

This is a divisional of Ser. No. 10/977,974, filed Oct. 29, 2004 and entitled INVESTMENT CASTING CORES AND METHODS, the disclosure of which is incorporated by reference herein as if set forth at length.

BACKGROUND OF THE INVENTION

The invention relates to investment casting. More particularly, the invention relates to the forming of core-containing patterns for investment forming investment casting molds.

Investment casting is a commonly used technique for forming metallic components having complex geometries, especially hollow components, and is used in the fabrication of superalloy gas turbine engine components.

Gas turbine engines are widely used in aircraft propulsion, electric power generation, ship propulsion, and pumps. In gas turbine engine applications, efficiency is a prime objective. Improved gas turbine engine efficiency can be obtained by operating at higher temperatures, however current operating temperatures in the turbine section exceed the melting points of the superalloy materials used in turbine components. Consequently, it is a general practice to provide air cooling. Cooling is typically provided by flowing relatively cool air from the compressor section of the engine through passages in the turbine components to be cooled. Such cooling comes with an associated cost in engine efficiency. Consequently, there is a strong desire to provide enhanced specific cooling, maximizing the amount of cooling benefit obtained from a given amount of cooling air. This may be obtained by the use of fine, precisely located, cooling passageway sections.

A well developed field exists regarding the investment casting of internally-cooled turbine engine parts such as blades, vanes, seals, combustors, and other components. In an exemplary process, a mold is prepared having one or more mold cavities, each having a shape generally corresponding to the part to be cast. An exemplary process for preparing the mold involves the use of one or more wax patterns of the part. The patterns are formed by molding wax over ceramic cores generally corresponding to positives of the cooling passages within the parts. In a shelling process, a ceramic shell is formed around one or more such patterns in a well known fashion. The wax may be removed such as by melting, e.g., in an autoclave. The shell may be fired to harden the shell. This leaves a mold comprising the shell having one or more part-defining compartments which, in turn, contain the ceramic core(s) defining the cooling passages. Molten alloy may then be introduced to the mold to cast the part(s). Upon cooling and solidifying of the alloy, the shell and core may be mechanically and/or chemically removed from the molded part(s). The part(s) can then be machined and/or treated in one or more stages.

The ceramic cores themselves may be formed by molding a mixture of ceramic powder and binder material by injecting the mixture into hardened metal dies. After removal from the dies, the green cores may then be thermally post-processed to remove the binder and fired to sinter the ceramic powder together. The trend toward finer cooling features has taxed ceramic core manufacturing techniques.

The cores defining fine features may be difficult to manufacture and/or, once manufactured, may prove fragile.

A variety of post-casting techniques were traditionally used to form the fine features. A most basic technique is conventional drilling. Laser drilling is another. Electrical discharge machining or electro-discharge machining (EDM) has also been applied. For example, in machining a row of cooling holes, it is known to use an EDM electrode of a comb-like shape with teeth having complementary shape to the holes to be formed. Various EDM techniques, electrodes, and hole shapes are shown in U.S. Pat. No. 3,604,884 of Olsson, U.S. Pat. No. 4,197,443 of Sidenstick, U.S. Pat. No. 4,819,325 of Cross et al., U.S. Pat. No. 4,922,076 of Cross et al., U.S. Pat. No. 5,382,133 of Moore et al., U.S. Pat. No. 5,605,639 of Banks et al., and U.S. Pat. No. 5,637,239 of Adamski et al. The hole shapes produced by such EDM techniques are limited by electrode insertion constraints.

Commonly-assigned co-pending U.S. Pat. No. 6,637,500 of Shah et al. discloses exemplary use of a ceramic and refractory metal core combination. With such combinations, generally, the ceramic core(s) provide the large internal features such as trunk passageways while the refractory metal core(s) provide finer features such as outlet passageways. As is the case with the use of multiple ceramic cores, assembling the ceramic and refractory metal cores and maintaining their spatial relationship during wax overmolding presents numerous difficulties. A failure to maintain such relationship can produce potentially unsatisfactory part internal features. It may be difficult to assemble fine refractory metal cores to ceramic cores. Once assembled, it may be difficult to maintain alignment. The refractory metal cores may become damaged during handling or during assembly of the overmolding die. Assuring proper die assembly and release of the injected pattern may require die complexity (e.g., a large number of separate die parts and separate pull directions to accommodate the various RMCs).

Separately from the development of RMCs, various techniques for positioning the ceramic cores in the pattern molds and resulting shells have been developed. U.S. Pat. No. 5,296,308 of Caccavale et al. discloses use of small projections unitarily formed with the feed portions of the ceramic core to position a ceramic core in the die for overmolding the pattern wax. Such projections may then tend to maintain alignment of the core within the shell after shelling and dewaxing.

Nevertheless, there remains room for further improvement in core assembly techniques.

SUMMARY OF THE INVENTION

One aspect of the invention involves a method for forming an investment casting pattern. A metallic first core element is formed including at least one recess. The first core element is engaged to at least a mating one of an element of a die and a second core element (if present). The recess serves to retain the first core element relative to the mating one. The die is assembled. Sacrificial material (e.g., wax) is introduced to the die to at least partially embed the first core element.

Various implementations involve forming the first core element from sheet stock having opposite first and second faces. The at least one recess may include a first recess in the first face and a second aligned recess in the second face. The first and second recesses may be elongate channels. The engaging may involve translating a first portion of the first core into a slot in the mating one so that a projecting portion of the mating one within the slot is received into the at least one recess so as to provide a mechanical back-locking effect. The forming may involve forming a regular pattern of recesses including the at least one recess. The engaging may leave exposed a number of the recesses of the regular pattern. The regular pattern may be pre-formed in flat sheet stock. The metallic first core element may be cut and/or shaped from such sheet stock.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
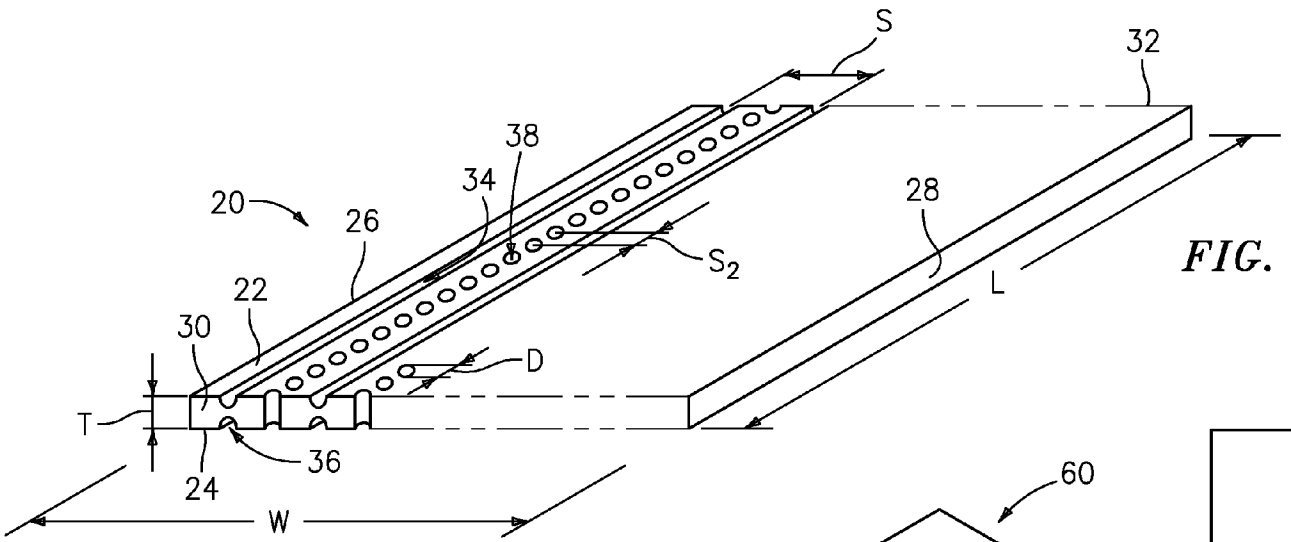
FIG. 1 is a view of a refractory metal-based sheet for forming one or more investment casting cores.
Figure 4:
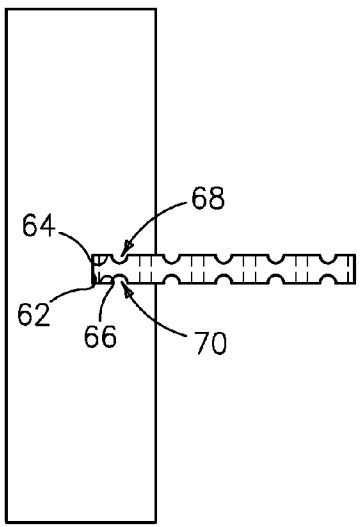
FIG. 4 is an end view of a slot in the component of FIG. 3 accommodating the RMC.

FIG. 1 shows a refractory metal-based sheet 20 for forming refractory metal cores for investment casting. Exemplary sheet materials include Mo, Nb, Ta, and W, alone or in combination and in elemental form, alloys, intermetallics, and the like. The exemplary sheet 20 is initially essentially flat having a thickness T between first and second surfaces 22 and 24. Exemplary thicknesses T are 0.2-5.0 mm. The sheet has a width W between perimeter edge surfaces 26 and 28 and a length L between perimeter end surfaces 30 and 32. Exemplary widths and lengths are much larger than T and may be from several centimeters upward.

According to one aspect of the invention, the sheet 20 may be pre-formed with surface features or other enhancements to serve one or more useful functions during the investment casting process. The exemplary sheet of FIG. 1 has enhancements including a first regular array of channel recesses 34 in the surface 22. The exemplary recesses 34 are linear at a constant spacing S. The exemplary recesses 34 have approximately semi-circular cross-sections. In the exemplary sheet, a similar array of similar recesses 36 is formed in the surface 24. In the exemplary sheet, the recesses 34 and 36 are at the same spacing and are parallel to and in-phase with each other, although other configurations are possible.

Figure 2:
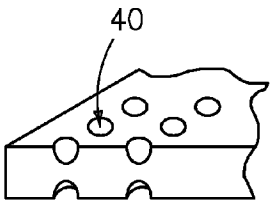
FIG. 2 is a partial view of an alternate sheet.

FIG. 1 further shows additional enhancements in the form of an array of lines of through-apertures 38 extending between the surfaces 22 and 24. The exemplary lines of through-apertures 38 are alternatingly interspersed with the recesses 34 and 36 at the spacing S. Within each line, the apertures have an on-center spacing $S_2$. The exemplary through-apertures are formed with a circular cross-section of diameter D. Among various alternatives are arrays of blind recesses (e.g., dimples 40 (FIG. 2)).

The enhancements may be formed in an initial unenhanced sheet by a variety of means including one or more of embossing, engraving, etching, and drilling/milling (e.g., photo-etching, laser etching, chemical milling, and the like). Once so formed, individual RMCs might be cut from the larger sheet and optionally further shaped (e.g., via stamping, bending, or other forming/shaping technique).

The enhancements may serve one or more of several purposes. The enhancements may provide for registration and/or engagement/retention of the RMC with one or more of a pattern-forming mold, another core (e.g., a molded ceramic core), and an investment casting shell formed over a pattern. The enhancements may provide features of the ultimate casting. For example, through-apertures may provide posts for enhanced heat transfer and/or structural integrity. Blind recesses may provide enhanced heat transfer due to increased surface area, increased turbulence, and the like.

Figure 3:
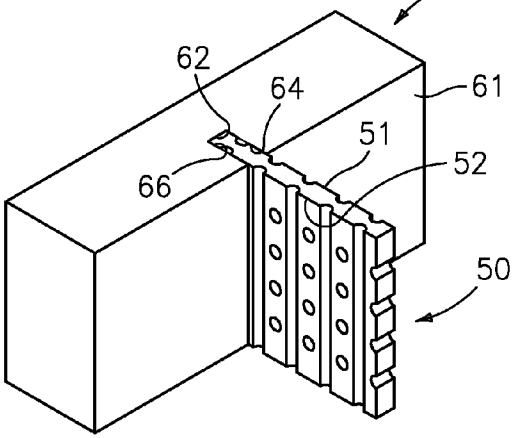
FIG. 3 is a view of a core cut from the sheet of FIG. 1 engaged to a pattern-forming die component.
Figure 5:
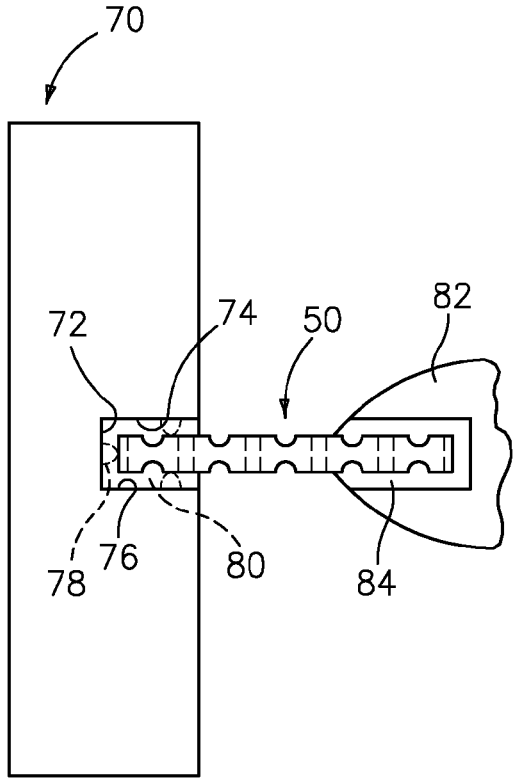
FIG. 5 is a view of an alternate die component accommodating the RMC.

FIG. 3 shows an RMC 50 cut from the sheet 20 of FIG. 1. The RMC 50 has side surfaces 51 and 52 from the surfaces 22 and 24. The RMC 50 has a lateral perimeter. A portion of the perimeter can be an intact portion of the perimeter of the sheet 20. The RMC 50 is mounted in an element of a wax molding die (e.g., a die insert 60 described in further detail below). The insert 60 has a slot formed in a first surface 61. The slot has a base 62 and first and second sides 64 and 66. Along the sides, elongate ribs 68 and 70 extend into the slot. The ribs 68 and 70 are complementary to an associated pair of the recesses 34 and 36 permitting the RMC 50 to be slid into the slot so as to provide a dovetail-like engagement. FIG. 5 shows an alternate insert 70 having a slot with a base 72 and first and second sides 74 and 76. The slot may have features (e.g., projections 78 for contacting and positioning the received portion of the RMC 50). Around the projections 78, a space between the slot and the RMC may be filled via a ceramic adhesive or other accommodating material 80 to secure the RMC to the insert. FIG. 5 further shows a cutaway ceramic core 82 receiving a second portion of the RMC 50. The second core 82 may be cast over the RMC 50. Alternatively, the RMC 50 may be positioned in a pre-formed slot in the ceramic core 82 and secured thereto via ceramic adhesive 84 or other securing material.

Figure 6:
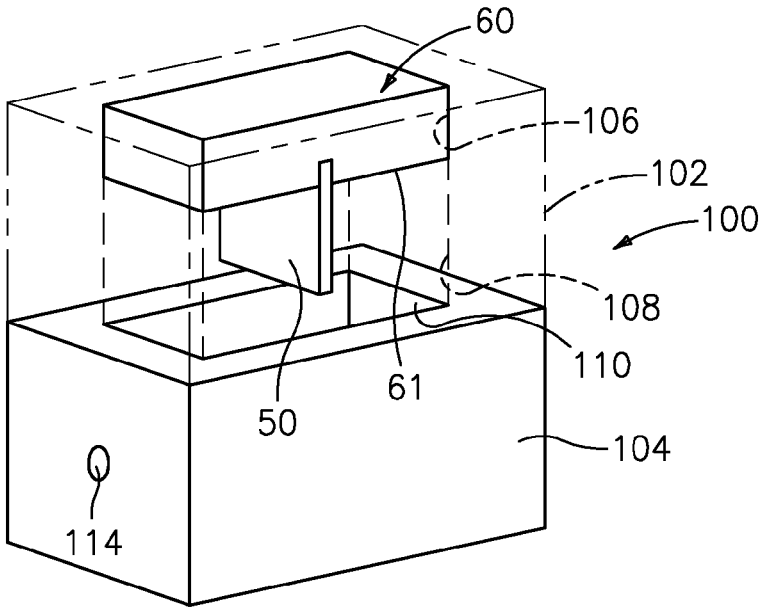
FIG. 6 is a view of the RMC within a pattern-forming die.

FIG. 6 shows a pattern-forming die assembly 100 including mating upper and lower halves 102 and 104. The insert 60 carrying the RMC 50 is shown accommodated in a compartment 106 of the upper die half 102. Combined internal surfaces 108 and 110 of the upper and lower die halves along with the underside 101 of the insert form a chamber for molding the pattern wax. The sacrificial pattern wax may be introduced through one or more ports 114 in the die halves or insert 60. The wax embeds the previously protruding portion of the RMC and any similarly exposed ceramic or other core within the die. After removal of the resultant pattern from the die, a ceramic shelling process (e.g., a slurry stuccoing process) may embed the RMC portion previously received in the slot. After dewaxing, molten metal may be introduced to the shell. After metal hardening, the RMC and any other cores may be removed from the casting (e.g., via chemical leaching).

Especially for smaller-scale manufacturing applications, use of the pre-enhanced RMC sheet material 20 may have substantial cost benefits in providing the aforementioned utility.

The dovetail RMC-to-die attachment function identified above may be reproduced in other situations. For example, rather than having a regular array of the recess pairs 34 and 36, the sheet 20 might be provided with only a single recess pair adjacent the edge 26 or even a single recess on one side 22 or 24 in the absence of an aligned recess on the other side. The enhancements across the remainder of the sheet (if any) may be otherwise formed (e.g., arrays of the apertures and/or dimples). Individual RMCs may be cut relative to the edge 26 so that the single recess or recess pair may be used to provide the dovetail interaction with the die. In yet another example, such recesses may be post-formed.

Figure 7:
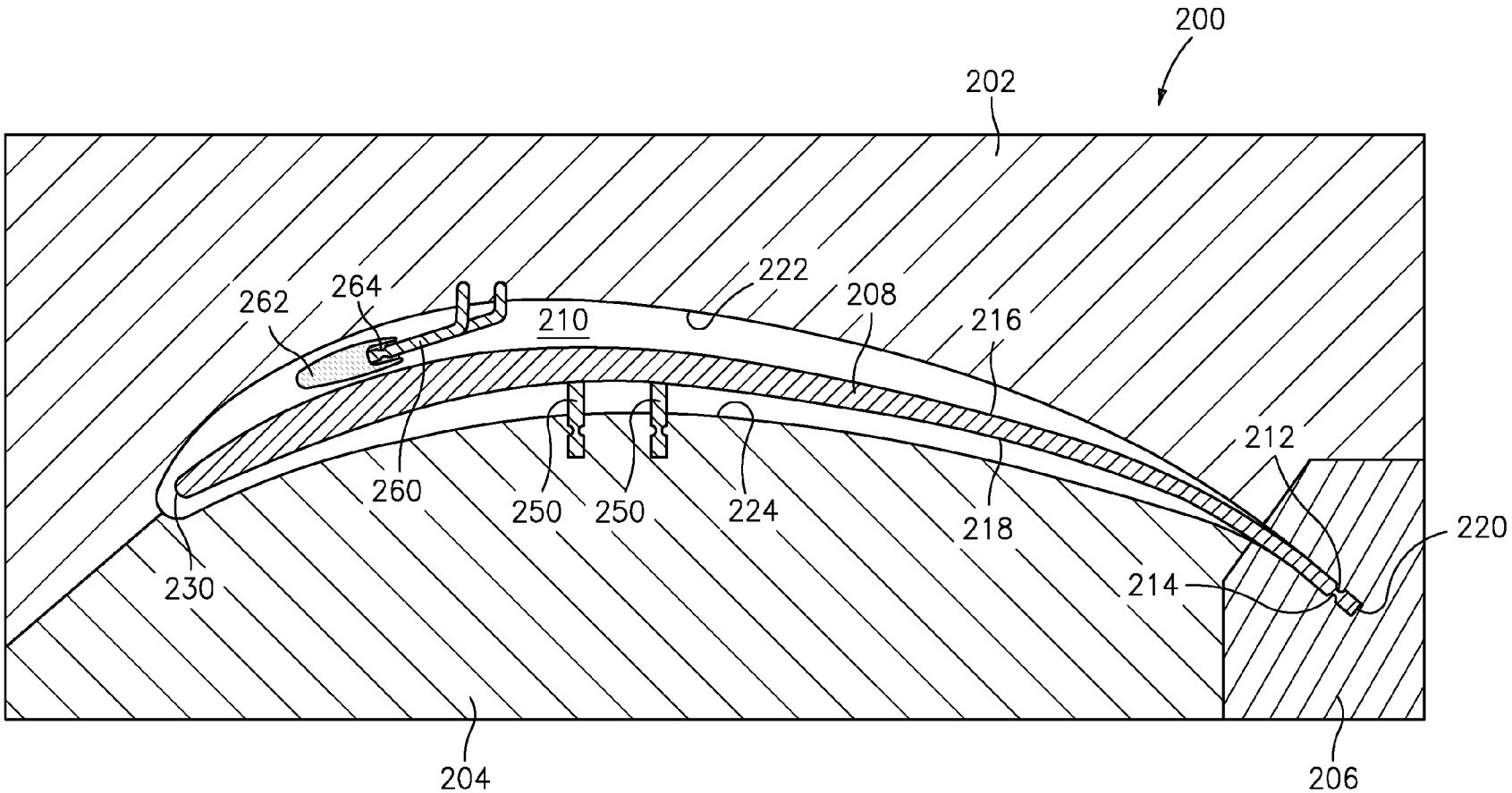
FIG. 7 is a sectional view of an alternate RMC within an alternate pattern-forming die.
Figure 8:
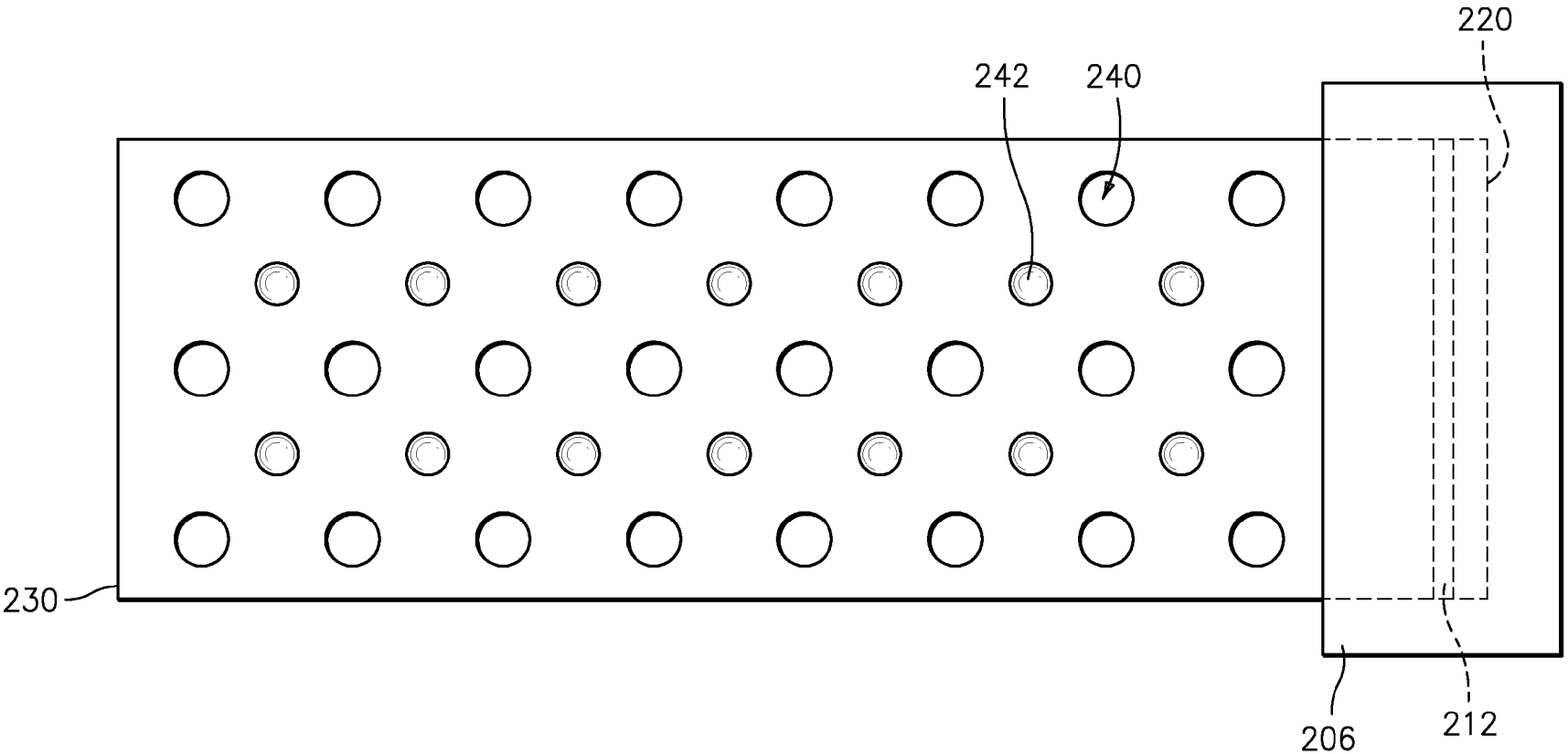
FIG. 8 is a view of the RMC held by an insert of the die of FIG. 7.

FIG. 7 shows an alternate pattern-forming die 200 having upper and lower halves 202 and 204. A die insert 206 holds an RMC 208 with a protruding portion thereof extending within a die cavity 210 for receiving the pattern wax. The insert 206 may be received in an associated compartment of one or both of the die halves or otherwise mated thereto. The exemplary RMC 208 has a single aligned pair of recesses 212 and 214 in first and second side surfaces 216 and 218 adjacent a first edge 220. Assembly of the RMC 208 to the insert 206 may be as described above. In the exemplary embodiment, along the protruding portion of the RMC 208, the surfaces 216 and 218 are generally arcuate with the former convex and the latter concave to fall between suction and pressure sides of an airfoil to be formed on the pattern by respective die surfaces 222 and 224. The exemplary RMC 208 has a second (leading) edge 230 distally of the insert 206. In the exemplary embodiment, a thickness of the RMC 208 between the surfaces 216 and 218 varies with position between the edges 230 and 220. For example, as does the airfoil, the thickness may relatively quickly increase in the downstream direction and then relatively slowly decrease so that a thickest point is in a leading half of the RMC. The RMC 208 may be fabricated by a variety of processes. A particular overall non-constant thickness (i.e., ignoring holes, recesses, and the like) may be directly prepared (e.g., by forging, extruding, or the like) or may be indirectly prepared from a constant thickness sheet (e.g., by rolling, stamping, chemical milling or etching, photo etching, electrochemical machining, electrical discharge machining, water jet machining, and the like). FIG. 8 shows the RMC 208 as having overlapping regular arrays of through-apertures 240 and dimples 242 (in each surface) for respectively forming posts and pedestals in a slot in the ultimate cast part. The arrays may advantageously be positioned and arranged so that the individual interspersed apertures and dimples do not overlap, although other configurations are possible. In an exemplary manufacture sequence the apertures and dimples are formed along with the recesses 212 and 214 when the thickness profile is also formed in an RMC precursor. Several such RMCs may then be cut from the precursor.

FIG. 7 further shows several additional exemplary sacrificial cores including metallic cores that may be similarly formed to the cores described above or may be otherwise formed. A pair of RMCs 250 have first portions held in slots in the lower die half 204 and second portions contacting and optionally supporting the second surface 218 of the RMC 208. Another RMC 260 has a first portion captured in a slot in a molded ceramic core 262 and secured thereto by a ceramic adhesive 264. A pair of second portions of the RMC 260 are captured in the die upper half 202. The ceramic core 262 may be held relative to the die at an end of the ceramic core or by molded-in-place bumps or by other means.

One or more embodiments of the present invention have been described. Nevertheless, it will be understood that various modifications may be made without departing from the spirit and scope of the invention. For example, details of the particular part to be cast may influence details of any particular implementation. Furthermore, the principles may be implemented in modifying an a variety of existing or yet-developed manufacturing processes for a variety of parts. The details of such processes and parts may influence the details of any implementation. Accordingly, other embodiments are within the scope of the following claims.

What is claimed is:

1. A combination of an investment casting core and a pattern-forming die element comprising:

a metallic body having first and second opposite faces; and at least one elongate recess in at least the first face, wherein the recess does not extend from said first face through said second face and the recess serves to engage a mating one of the die element and a second casting core so as to retain the core relative to the mating one.

2. The core of claim 1 wherein:

the first and second faces are first and second faces of a sheet, the core having width and length to along the first and second faces longer than a thickness between the first and second faces.

3. The core of claim 1 wherein:

at no location does the recess form a hole to the second face.

4. The core of claim 1 wherein:

the elongate recess is an edge-to-edge channel.

5. The core of claim 1 wherein:

the at least one elongate recess includes a first recess in the first face and a second aligned recess in the second face.

6. The core of claim 1 wherein:

the at least one elongate recess includes a regular array of first recesses in the first face and second aligned recesses in the second face.

7. The core of claim 6 further comprising:

a regular array of through-holes between the first and second faces.

8. The core of claim 1 wherein:

the metallic body consists in major weight part of one or more refractory metals.

9. The core of claim 1 further comprising:

a coating on the metallic body including along the one or more recesses.

10. A combination of an investment casting core and a pattern-forming die element, wherein said investment casting core comprises comprising:

a first metallic core having first and second opposite faces;

means for mounting the first metallic core in at least one of a said pattern-forming die element and a second core; and means for forming a passageway surface enhancement in a cast part.

11. The core of claim 10 wherein:

the means for mounting and the means for forming each include one or more recesses of a shared regular pattern of recesses.

12. The core of claim 10 further comprising:

a coating on the metallic body including covering the one or more recesses.

* * * * *

UNITED STATES PATENT AND TRADEMARK OFFICE

CERTIFICATE OF CORRECTION

PATENT NO. : 7,278,463 B2
APPLICATION NO. : 11/421115
DATED : October 9, 2007
INVENTOR(S) : Jacob A. Snyder et al.

It is certified that error appears in the above-identified patent and that said Letters Patent is hereby corrected as shown below:

In column 6, claim 2, line 22, after "length" delete "to".

In column 6, claim 10, line 49, delete "comprising".

In column 6, claim 10, line 52, before "said pattern forming" delete "a".

Signed and Sealed this

Twenty-first Day of October, 2008

JON W. DUDAS
*Director of the United States Patent and Trademark Office*